US008757118B2

(12) United States Patent
Kawahara et al.

(10) Patent No.: US 8,757,118 B2
(45) Date of Patent: Jun. 24, 2014

(54) SHIM FOR VALVE DRIVE MECHANISM, AND VALVE DRIVE MECHANISM

(71) Applicant: Otics Corporation, Nishio (JP)

(72) Inventors: Kazunori Kawahara, Nishio (JP); Masateru Kishi, Nishio (JP)

(73) Assignee: Otics Corporation, Nishio-Shi, Aichi-Ken (JP)

( * ) Notice: Subject to any disclaimer, the term of this patent is extended or adjusted under 35 U.S.C. 154(b) by 0 days.

(21) Appl. No.: 13/773,870

(22) Filed: Feb. 22, 2013

(65) Prior Publication Data

US 2013/0233266 A1 Sep. 12, 2013

(30) Foreign Application Priority Data

Mar. 6, 2012 (JP) ..... 2012-049518

(51) Int. Cl.
*F01L 1/14* (2006.01)

(52) U.S. Cl.
USPC ..... 123/90.48; 123/90.39; 74/559; 74/569

(58) Field of Classification Search
USPC ..... 123/90.39, 90.48; 74/559, 569
See application file for complete search history.

(56) References Cited

U.S. PATENT DOCUMENTS 7,424,876 B2 * 9/2008 Diggs ..... 123/90.41

FOREIGN PATENT DOCUMENTS

JP 08-193507 A 7/1996

* cited by examiner

*Primary Examiner* — Ching Chang
(74) *Attorney, Agent, or Firm* — McGinn IP Law Group, PLLC

(57) ABSTRACT

The present invention provides a shim for a valve drive mechanism which is interposed between a pad surface of a rocker arm and a stem end surface of a valve. The shim includes a ship top surface that is contacted by the pad surface. The shim top surface is rotated about a center thereof to be cut, is provided with a center hole at the center thereof, and is shaped such that the pad surface does not contact an intersection line between an inner peripheral surface of the center hole and the shim top surface when the rocker arm is swung.

12 Claims, 4 Drawing Sheets

SHIM FOR VALVE DRIVE MECHANISM, AND VALVE DRIVE MECHANISM

TECHNICAL FIELD

The present invention relates to a valve drive mechanism for an internal combustion engine including a shim interposed between a rocker arm and a valve to adjust a valve clearance, and to a shim for a valve drive mechanism.

BACKGROUND ART

In some valve drive mechanisms in which a valve 52 is opened and closed by a rocker arm 50 as shown in FIG. 4A, a shim 55 having a predetermined thickness selected from a plurality of ranks of shims is interposed between a pad surface 51 of the rocker arm 50 and a stem end surface 53 of the valve 52 to adjust a valve clearance. The plurality of ranks of shims have respective plate-like portions with thicknesses that differ by several tens of μm (Patent Literature 1). The shim 55 includes a plate-like portion 56 and a tubular portion 57 extending downward from the peripheral portion of the plate-like portion 56. The valve 52 is fitted into the tubular portion 57 from below so that the stem end surface 53 contacts the lower surface of the plate-like portion 56, which causes the pad surface 51 to contact a shim top surface 58 which is the upper surface of the plate-like portion 56.

The shim top surface 58 is prepared by a variety of methods. In the case where the shim top surface 58 is prepared by cutting, the shim 55 is set onto a lathe, and rotated about a center X of the shim top surface 58. A blade is applied to the shim top surface 58 to perform cutting. At the center X of the shim top surface 58, the peripheral speed is 0 even during rotation, and thus cutting cannot be performed. Therefore, a center hole 59 has been formed at the center X before the cutting. The center hole 59 does not disappear but remains even after the cutting, and an intersection line a between an inner peripheral surface 60 of the center hole 59 and the shim top surface 58 defines a corner portion of an opening edge of the center hole 59.

The shim top surface 58 has been crowned with its center bulged upward by a difference in height of about 1 to 20 μm as shown in FIG. 4B for the purpose of preventing corner contact due to misalignment with respect to the rocker arm 50, that is, a phenomenon that a corner of the pad surface 51 contacts the shim top surface 58 when the rocker arm 50 is tilted. This crowning is also intended to facilitate cutting.

Similarly, the pad surface 51 facing downward has also been crowned with its center bulged downward by a difference in height of about 1 to 30 μm in the width direction, and with its center bulged downward by a radius of curvature of about 10 to 20 mm in the longitudinal direction.

In FIGS. 4B and 4C, the curves of the shim top surface 58 and the pad surface 51 are shown as exaggerated compared to the actual curves for clarity.

CITATION LIST

Patent Literature

Patent Literature 1: Japanese Patent Application Publication No. 08-193507 (JP 08-193507 A)

SUMMARY OF INVENTION

Technical Problem

When the rocker arm 50 is swung, the rocker arm 50 moves the valve 52 upward and downward with the pad surface 51 contacting the shim top surface 58 at a moving contact point. In this event, the pad surface 51 also contacts the intersection line a between the inner peripheral surface 60 of the center hole 59 and the shim top surface 58 (corner portion of the opening edge of the center hole 59) as shown in FIG. 4B, which raises the contact pressure at the intersection line a. This may cause abnormal wear of the intersection line a (corner portion) as shown in FIG. 4C.

In view of the foregoing, an object of the present invention is to provide a shim including a shim top surface prepared by cutting and having a center hole formed at the center of the shim top surface, in which a raise in contact pressure at an intersection line between the inner peripheral surface of the center hole and the shim top surface (corner portion of an opening edge of the center hole) that may be caused when a rocker arm is swung with its pad surface contacting the shim top surface at a moving contact point is prevented to prevent occurrence of abnormal wear.

Solution to Problem

In order to achieve the foregoing object, a first aspect of the present invention provides a shim for a valve drive mechanism that is interposed between a pad surface of a rocker arm and a stem end surface of a valve and that includes a shim top surface that is contacted by the pad surface. In the shim, the shim top surface is rotated about a center thereof to be cut, is provided with a center hole at the center thereof because the cutting cannot be performed at the center, and is shaped such that the pad surface does not contact an intersection line between an inner peripheral surface of the center hole and the shim top surface when the rocker arm is swung.

The shim top surface may be shaped such that an intermediate diameter portion thereof having a predetermined intermediate diameter is the highest, and such that a center-side portion extending from the intermediate diameter portion to the intersection line has a height that decreases from the intermediate diameter portion toward the intersection line. The predetermined intermediate diameter is smaller than a maximum contact diameter of the shim top surface contacted by the pad surface when the rocker arm is swung.

In the configuration described above, the predetermined intermediate diameter is preferably equal to or more than 20% of the maximum contact diameter, and is more preferably equal to or more than 30 to 50% of the maximum contact diameter. If the predetermined intermediate diameter is less than 20% of the maximum contact diameter, the center-side portion may be so narrow as to cause abrupt variations in height, which may cause a raise in contact pressure.

In the configuration described above, the intersection line is preferably lower than the intermediate diameter portion by 1 to 30 μm, and is more preferably lower than the intermediate diameter portion by 1.5 to 20 μm. If the intersection line is lower than the intermediate diameter portion by less than 1 μm, the pad surface which has been crowned may contact the intersection line. If the intersection line is lower than the intermediate diameter portion by more than 30 μm, the intersection line may be unnecessarily low only to reduce the strength of the plate-like portion.

In the configuration described above, the center-side portion of the shim top surface is preferably a curved surface having a sectional shape with a radius of curvature that is 2 to 200 times the intermediate diameter. Further, the radius of curvature is more preferably 3 to 150 times the intermediate diameter. This allows a suitable range of the intermediate diameter and a suitable height of the intersection line to be achieved appropriately. In addition, variations in height of the center-side portion are gentle so that a raise in contact pressure does not occur. The center-side portion of the shim top surface may be any of a variety of curved surfaces, having a sectional shape defined by an elliptic curve, an exponential curve, a sinusoidal curve, or the like.

The shim top surface is preferably shaped such that a periphery-side portion extending from the intermediate diameter portion to a shim top surface periphery has a height that decreases from the intermediate diameter portion toward the shim top surface periphery. This prevents corner contact due to misalignment with respect to the rocker arm.

In the configuration described above, the shim top surface periphery is preferably lower than the intermediate diameter portion by 1 to 40 μm, and is more preferably lower than the intermediate diameter portion by 5 to 30 μm. If the shim top surface periphery is lower than the intermediate diameter portion by more than 40 μm, the shim top surface periphery may be unnecessarily low only to reduce the strength of the plate-like portion.

In the configuration described above, the periphery-side portion of the shim top surface is preferably a curved surface having a sectional shape with a radius of curvature that is 25 to 300 times the maximum contact diameter. Further, the radius of curvature is more preferably 30 to 100 times the maximum contact diameter. This allows a suitable height of the shim top surface periphery to be achieved appropriately. In addition, variations in height of the periphery-side portion are gentle so that a raise in contact pressure does not occur. The periphery-side portion of the shim top surface may be any of a variety of curved surfaces, having a sectional shape defined by an elliptic curve, an exponential curve, a sinusoidal curve, or the like.

In addition, the diameter of an opening edge (intersection line described above) of the center hole is preferably 0.2 to 2.0 mm, and is more preferably 0.5 to 1.5 mm. If the diameter of the opening edge of the center hole is equal to or less than 0.2 mm, machining may be difficult. If the diameter of the opening edge of the center hole is equal to or more than 2.0 mm, the center hole may make contact of the shim top surface with the pad surface unstable.

In order to achieve the object describe above, a second aspect of the present invention provides a valve drive mechanism including: a rocker arm having a crowned pad surface; and a shim that is interposed between the pad surface of the rocker arm and a stem end surface of a valve and that has a shim top surface that is contacted by the pad surface. In the valve drive mechanism, the shim top surface is rotated about a center thereof to be cut, is provided with a center hole at a center thereof because the cutting cannot be performed at the center, and is shaped such that the pad surface does not contact an intersection line between an inner peripheral surface of the center hole and the shim top surface when the rocker arm is swung.

The descriptions of the shape of the shim top surface provided above are also applied to the shim of the valve drive mechanism.

Advantageous Effects of Invention

According to the aspects of the present invention, it is possible to provide a shim including a shim top surface prepared by cutting and having a center hole formed at the center of the shim top surface, in which a raise in contact pressure at an intersection line between the inner peripheral surface of the center hole and the shim top surface (corner portion of an opening edge of the center hole) that may be caused when a rocker arm is swung with its pad surface contacting the shim top surface at a moving contact point is prevented, thereby preventing occurrence of abnormal wear.

DESCRIPTION OF EMBODIMENTS

First Embodiment

Figure 1:
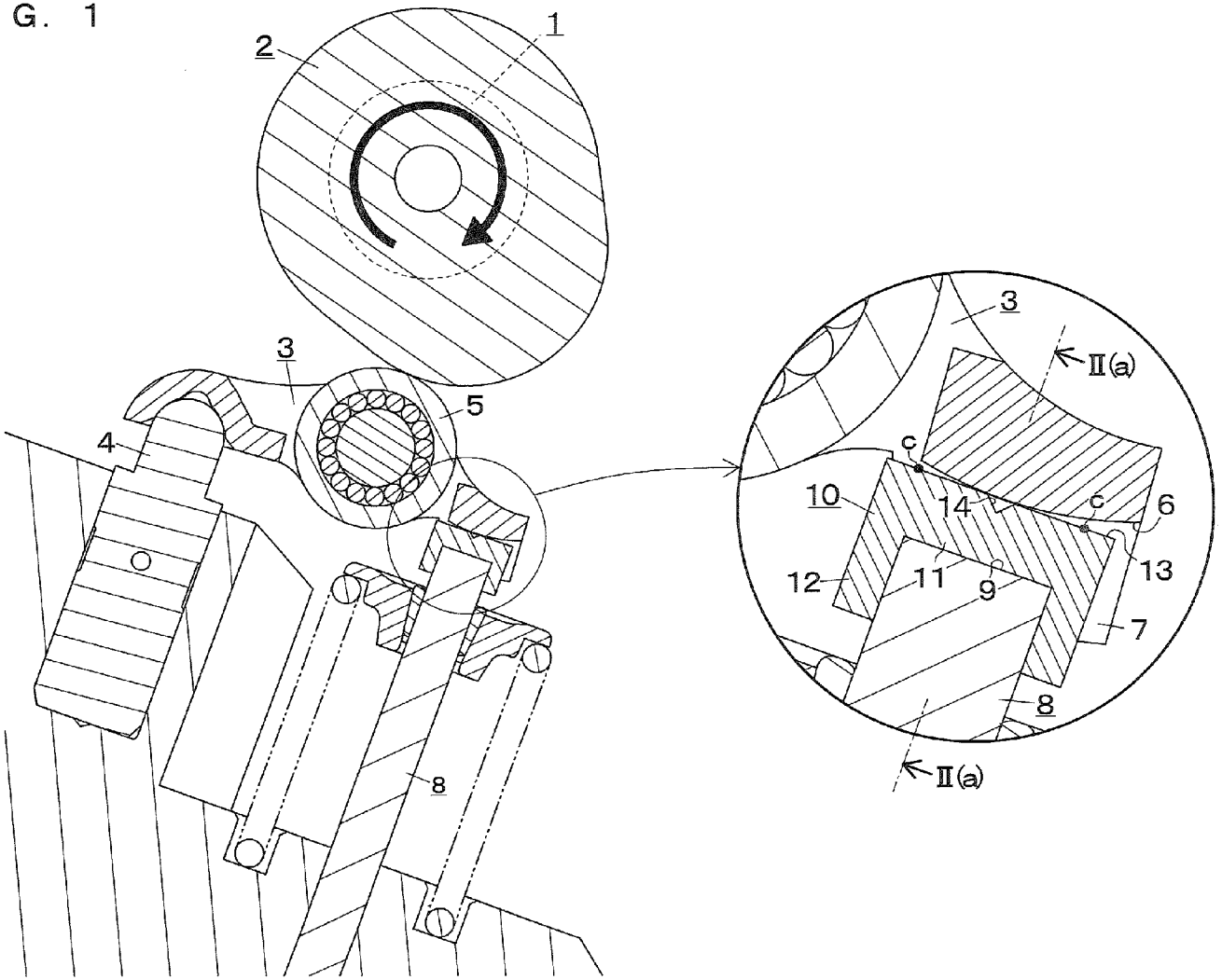
FIG. 1 is a side sectional view showing a valve drive mechanism according to an embodiment.
Figure 2A:
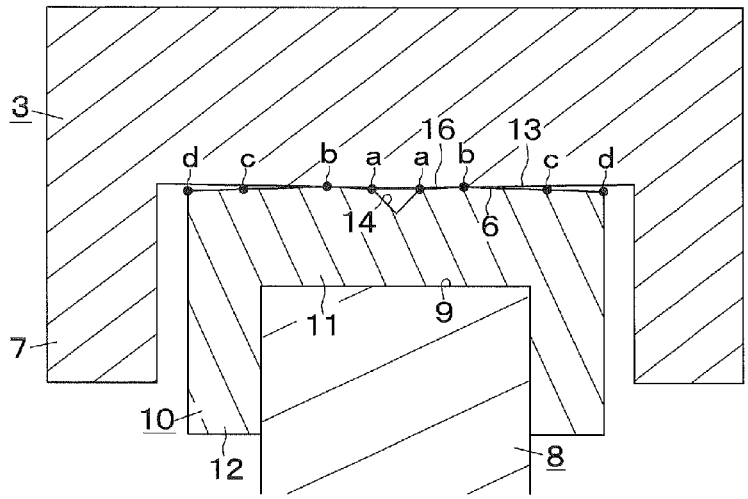
FIG. 2A is a front sectional view showing a pad surface of a rocker arm, a shim, and a stem end surface of a valve of the valve drive mechanism.
Figure 2B:
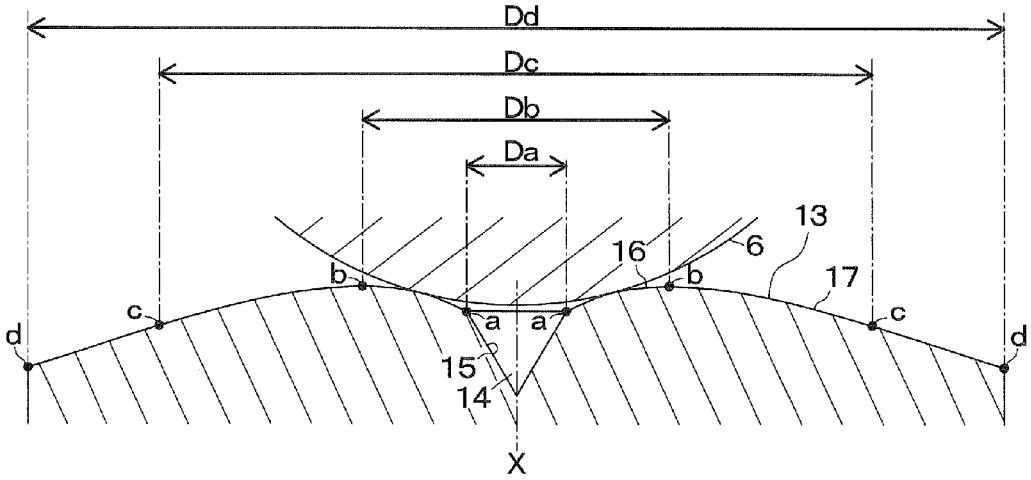
FIG. 2B is a front sectional view showing the pad surface of the rocker arm and a shim top surface of the shim.
Figure 3A:
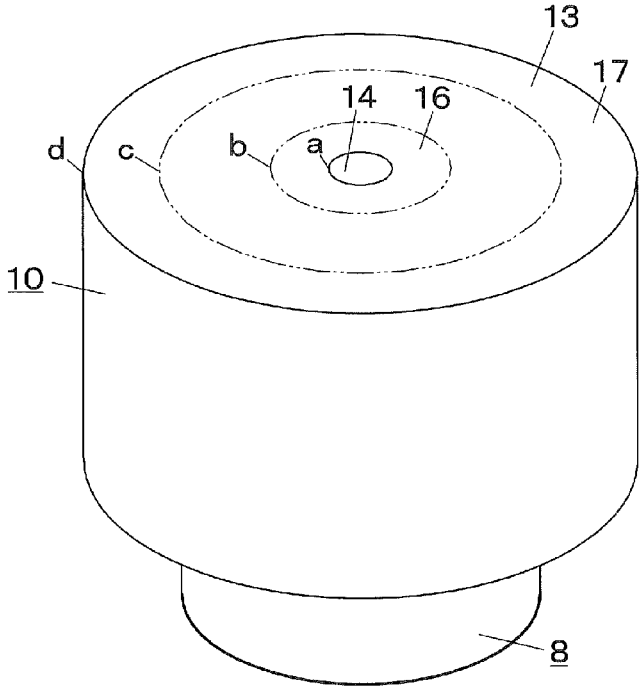
FIG. 3A is a perspective view showing the shim of the valve drive mechanism.
Figure 3B:
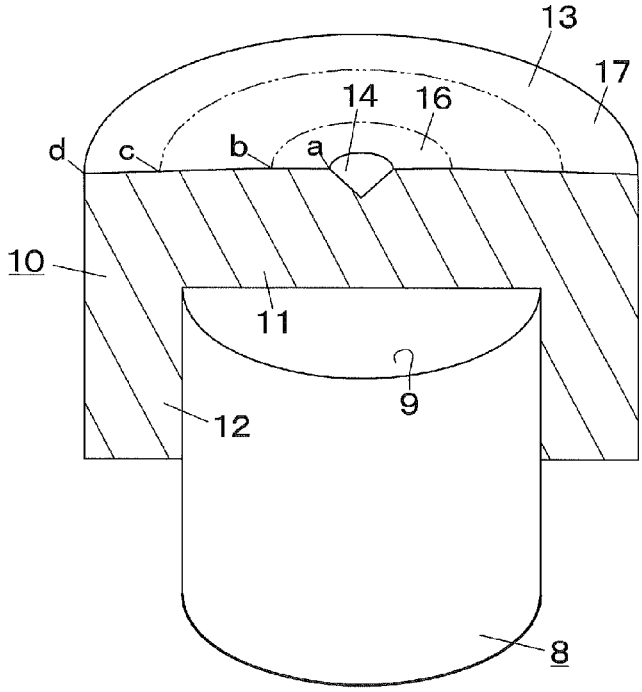
FIG. 3B is a perspective view showing the shim partially in section.
Figure 4A:
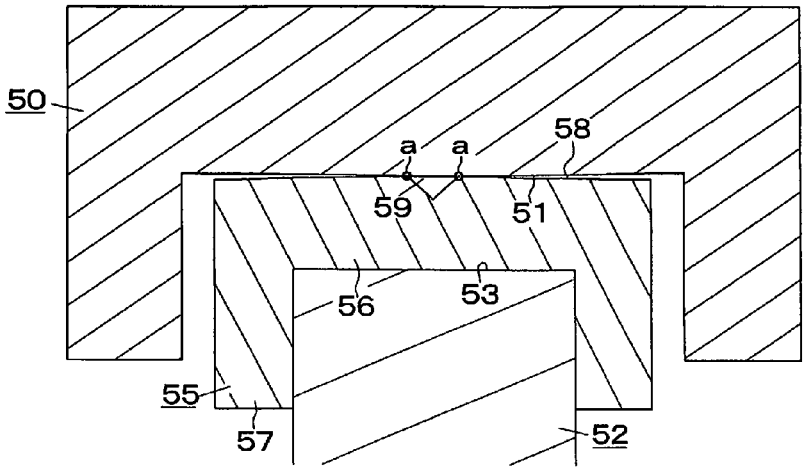
FIG. 4A PRIOR ART
FIG. 4A is a front sectional view showing a pad surface of a rocker arm, a shim, and a stem end surface of a valve of a valve drive mechanism according to the related art.
Figure 4B:
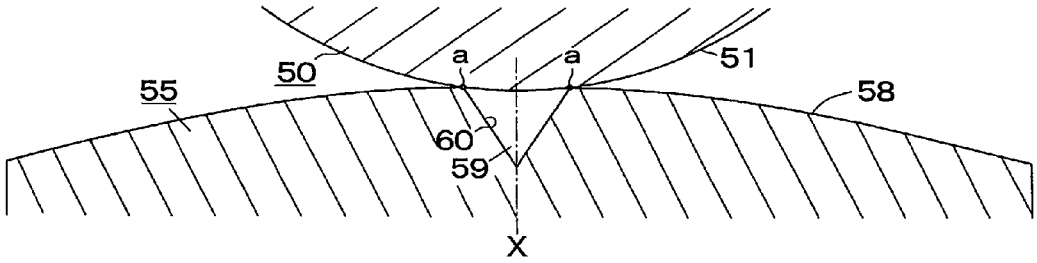
FIG. 4B PRIOR ART
FIG. 4B is a front sectional view showing the pad surface of the rocker arm and a shim top surface of the shim.
Figure 4C:
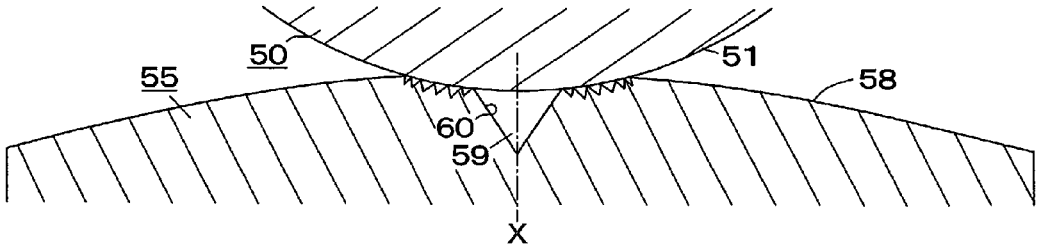
FIG. 4C PRIOR ART
FIG. 4C is a front sectional view showing a state in which a corner portion of an opening edge of a center hole in the shim top surface has been worn.

FIGS. 1 to 3 show a valve drive mechanism according to an embodiment. In FIG. 2B, the curves of a pad surface 6 and a shim top surface 13 are shown as exaggerated compared to the actual curves for clarity. A rotary cam 2 is formed on a cam shaft 1. A rocker arm 3 is provided below the rotary cam 2. The base end portion of the rocker arm 3 is supported by a pivot 4 so as to be swingable. A roller 5 that contacts the rotary cam 2 is rotatably mounted at an intermediate portion of the rocker arm 3 in the longitudinal direction. A pad surface 6 facing downward is formed on the lower surface of the distal end portion of the rocker arm 3. Sidewalls 7 are formed at both side portions of the distal end portion of the rocker arm 3 to extend downward so that the pad surface 6 is interposed between the sidewalls 7. The pad surface 6 facing downward has been crowned with its center bulged downward in the width direction. The difference in height between the center and both ends in the width direction is 25 μm. The pad surface 6 has also been crowned with its center bulged downward by a radius of curvature of 15 mm in the longitudinal direction.

A valve 8 is provided below the pad surface 6 so as to be movable upward and downward. A shim 10 is interposed between the pad surface 6 and a stem end surface 9 of the valve 8. The shim 10 includes a circular plate-like portion 11 and a cylindrical tubular portion 12 extending downward from the peripheral portion of the plate-like portion 11. The valve 8 is fitted inside the tubular portion 12 so that the stem end surface 9 contacts the lower surface of the plate-like portion 11, which causes the pad surface 6 to contact a shim top surface 13 which is the upper surface of the plate-like portion 11. Hence, a plurality of ranks of the shims 10 having their respective plate-like portions 11 with thicknesses that differ by several tens of micrometers (μm) have been prepared, and a shim 10 having a predetermined thickness selected from the shims 10 is interposed as described above to adjust a valve clearance.

Exemplary dimensions of the shim 10 are as follows. The plate-like portion 11 has a thickness of about 2 mm (providing a plurality of ranks described above). The outside diameter of the plate-like portion 11 and the tubular portion 12 is 8.5 mm.

The inside diameter of the tubular portion 12 is 5.5 mm. The height from the lower end of the tubular portion 12 to the shim top surface 13 is about 5 mm. Hence, although a diameter Dd of the periphery (hereinafter referred to as "shim top surface periphery d") of the shim top surface 13 is 8.5 mm, the pad surface 6 does not contact the entire shim top surface 13. In the embodiment, a maximum contact diameter Dc corresponding to a diameter of a maximum range c of the shim top surface 13 contacted by the pad surface 6 at a moving contact point when the rocker arm 3 is swung is 6.2 mm.

The shim 10 has been prepared by integrally shaping the plate-like portion 11 and the tubular portion 12 by forging, subjecting them to a heat treatment, and thereafter forming the shim top surface 13 by cutting. Specifically, as in the example according to the related art described above, the shim 10 formed by forging is set onto a lathe, and rotated about a center X of the shim top surface 13. A blade is applied to the shim top surface 13 to perform cutting. At the center X of the shim top surface 13, the peripheral speed is 0 even during rotation, and thus cutting cannot be performed. Therefore, a center hole 14 is formed at the center X before the cutting (at the same time as the forging described above, for example). Exemplary geometry of the center hole 14 before the cutting is as follows. The center hole 14 has an inverted cone shape with an opening edge diameter of about 1 mm and a depth of about 0.5 mm. Because the amount of the cutting is small, variation in dimension after the cutting is equal to or less than 0.2 mm. Thus, the center hole 14 does not disappear but remains even after the cutting, and an intersection line a between an inner peripheral surface 15 of the center hole 14 and the shim top surface 13 is defined in a circular shape. The intersection line a defines a corner portion of the opening edge of the center hole 14.

In the embodiment, the shape of the shim top surface 13 is set such that the pad surface 6 of the rocker arm 3 does not contact the intersection line a described above when the rocker arm 3 is swung. The thus shaped shim top surface 13 has been prepared by the cutting described above.

Specifically, the shim top surface 13 is shaped such that an intermediate diameter portion b having a predetermined intermediate diameter Db is the highest, and such that a center-side portion 16 extending from the intermediate diameter portion b to the intersection line a has a height that decreases from the intermediate diameter portion b toward the intersection line a. The predetermined intermediate diameter Db is smaller than the maximum contact diameter Dc described above. An exemplary value of the predetermined intermediate diameter Db is 2.5 to 3 mm, which is 40 to 48% of the maximum contact diameter Dc. Thus, the center-side portion 16 has an appropriate area. Therefore, the contact pressure is not raised, or the contact area of the shim top surface 13 with the pad surface 6 is not decreased excessively.

The intersection line a is lower than the intermediate diameter portion b by about 15 μm. Thus, the pad surface 6 which has been crowned does not contact the intersection line a when the rocker arm 3 is swung with its pad surface 6 contacting the shim top surface 13 at a moving contact point. Therefore, a raise in contact pressure at the intersection line a (corner portion of the opening edge of the center hole 14) can be prevented to prevent occurrence of abnormal wear.

The center-side portion 16 is a curved surface having a sectional shape with a radius of curvature of 10 mm, which is included in the range of 3.3 to 4 times the intermediate diameter Db. Thus, a preferable range of the intermediate diameter Db and a suitable height of the intersection line a can be achieved appropriately. In addition, variations in height of the center-side portion 16 are gentle so that a raise in contact pressure does not occur.

In addition, the shim top surface 13 is shaped such that a periphery-side portion 17 extending from the intermediate diameter portion b to a shim top surface periphery d has a height that decreases from the intermediate diameter portion b toward the shim top surface periphery d. This prevents corner contact due to misalignment with respect to the rocker arm 3.

The shim top surface periphery d is lower than the intermediate diameter portion b by about 20 μm. This does not reduce the strength of the plate-like portion.

The periphery-side portion 17 is a curved surface having a sectional shape with a radius of curvature of 240 mm, which is 38 times the maximum contact diameter Dc. Thus, a suitable height of the shim top surface periphery d can be achieved appropriately. In addition, variations in height of the periphery-side portion 17 are gentle so that a raise in contact pressure does not occur.

The present invention is not limited to the embodiment described above, and may be modified appropriately without departing from the scope of the present invention.

REFERENCE SIGNS LIST

3 rocker arm
6 pad surface
8 valve
9 stem end surface
10 shim
13 shim top surface
14 center hole
15 inner peripheral surface
16 center-side portion
17 periphery-side portion
X center of center hole
a intersection line
b intermediate diameter portion
c maximum range of shim top surface contacted by pad surface
d shim top surface periphery
Da diameter of opening edge of center hole
Db intermediate diameter
Dc maximum contact diameter
Dd diameter of shim top surface periphery

The invention claimed is:

1. A shim for a valve drive mechanism, which is interposed between a pad surface of a rocker arm and a stem end surface of a valve, the shim comprising:

a shim top surface that is contacted by the pad surface, wherein the shim top surface is rotated about a center thereof to be cut, the shim top surface is provided with a center hole at the center thereof, and the shim top surface is shaped such that the pad surface does not contact an intersection line between an inner peripheral surface of the center hole and the shim top surface when the rocker arm is swung.

2. The shim for a valve drive mechanism according to claim 1, wherein the shim top surface is shaped such that an intermediate diameter portion thereof having a predetermined intermediate diameter is the highest, and such that a center-side portion extending from the intermediate diameter portion to the intersection line has a height that decreases from the intermediate diameter portion toward the intersection line, the predetermined intermediate diameter being smaller than a maximum contact diameter of the shim top surface contacted by the pad surface when the rocker arm is swung.

3. The shim for a valve drive mechanism according to claim 2, wherein the predetermined intermediate diameter is equal to or more than 20% of the maximum contact diameter.

4. The shim for a valve drive mechanism according to claim 3, wherein the intersection line is lower than the intermediate diameter portion by 1 to 30 μm.

5. The shim for a valve drive mechanism according to claim 4, wherein the center-side portion of the shim top surface is a curved surface having a sectional shape with a radius of curvature that is 2 to 200 times the intermediate diameter.

6. The shim for a valve drive mechanism according to claim 2, wherein the shim top surface is shaped such that a periphery-side portion extending from the intermediate diameter portion to a shim top surface periphery has a height that decreases from the intermediate diameter portion toward the shim top surface periphery.

7. The shim for a valve drive mechanism according to claim 6, wherein the shim top surface periphery is lower than the intermediate diameter portion by 1 to 40 μm.

8. The shim for a valve drive mechanism according to claim 7, wherein the periphery-side portion of the shim top surface is a curved surface having a sectional shape with a radius of curvature that is 25 to 300 times the maximum contact diameter.

9. The shim for a valve drive mechanism according to claim 3, wherein the shim top surface is shaped such that a periphery-side portion extending from the intermediate diameter portion to a shim top surface periphery has a height that decreases from the intermediate diameter portion toward the shim top surface periphery.

10. The shim for a valve drive mechanism according to claim 9, wherein the shim top surface periphery is lower than the intermediate diameter portion by 1 to 40 μm.

11. The shim for a valve drive mechanism according to claim 10, wherein the periphery-side portion of the shim top surface is a curved surface having a sectional shape with a radius of curvature that is 25 to 300 times the maximum contact diameter.

12. A valve drive mechanism comprising:

a rocker arm having a crowned pad surface; and a shim that is interposed between the crowned pad surface of the rocker arm and a stem end surface of a valve and that has a shim top surface that is contacted by the crowned pad surface, wherein the shim top surface is rotated about a center thereof to be cut, the shim top surface is provided with a center hole at a center thereof, and the shim top surface is shaped such that the crowned pad surface does not contact an intersection line between an inner peripheral surface of the center hole and the shim top surface when the rocker arm is swung.

* * * * *